United States Patent [19]

Fariello

[11] 4,137,353

[45] Jan. 30, 1979

[54] FABRIC COMPRISING A NOVEL TYPE OF NETTING

[76] Inventor: Leonard A. Fariello, Box 173, Troy Meadows Rd., Whippany, N.J. 07981

[21] Appl. No.: 580,731

[22] Filed: May 27, 1975

[51] Int. Cl.[2] ..... B32B 5/12

[52] U.S. Cl. ..... 428/112; 428/116; 428/178; 428/257

[58] Field of Search ..... 428/105, 107, 112, 113, 428/117, 118, 116, 137, 178, 188, 257, 247, 258, 259, 298, 299; 156/148, 167, 180, 181, 197, 229, 244

[56] References Cited

U.S. PATENT DOCUMENTS

| | | | |
|---|---|---|---|
| 2,202,013 | 5/1940 | Lougheed | 428/229 |
| 3,252,833 | 5/1966 | Skobel | 428/297 |
| 3,983,281 | 9/1976 | Wakeman | 428/257 |

*Primary Examiner*—James J. Bell

*Attorney, Agent, or Firm*—Bernard J. Murphy

[57] ABSTRACT

The fabric comprises a novel type of netting which will have particular utility in screening out mosquitoes and like insects and pests. The fabric is defined of voids having depth as well as width and length. The fabric is usable as a material from which to form clothing for wear, or bed coverings, or sleeping bags, etc., besides use simply as a netting.

6 Claims, 6 Drawing Figures

FIG. 1
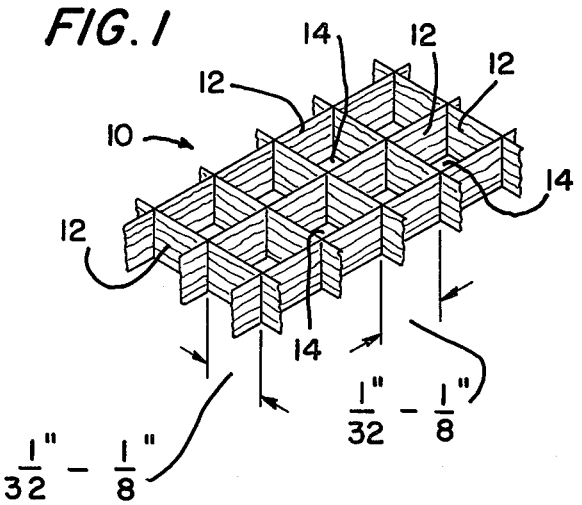
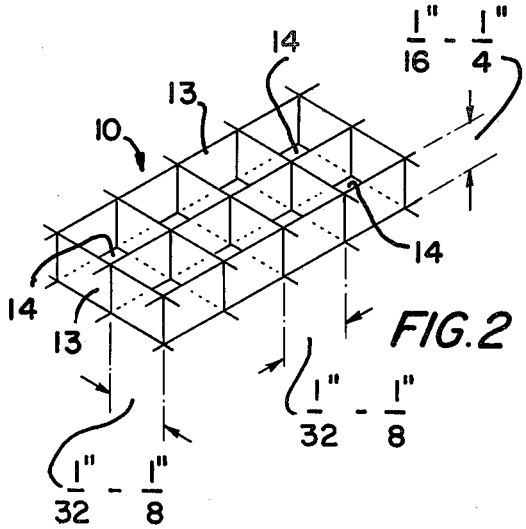
FIG. 2
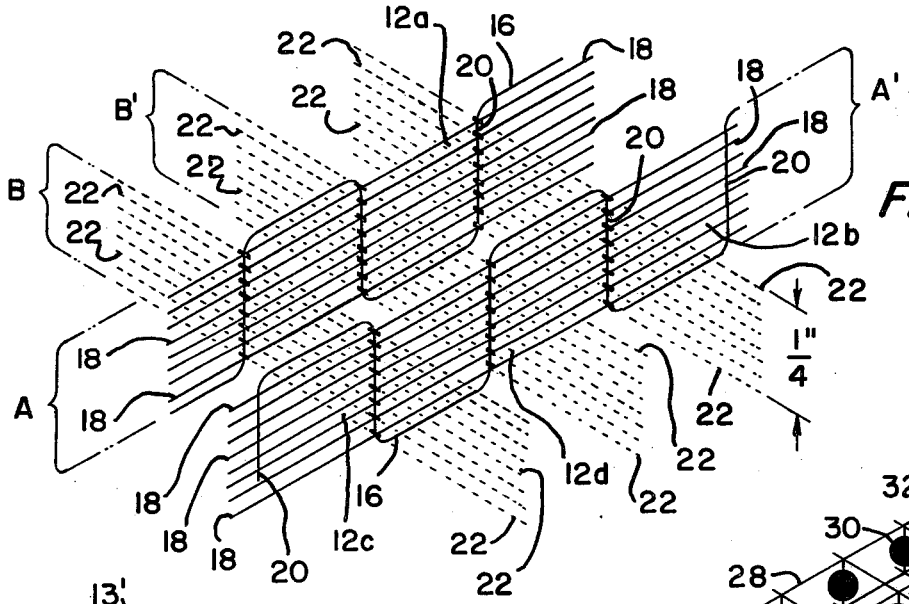
FIG. 3
FIG. 5
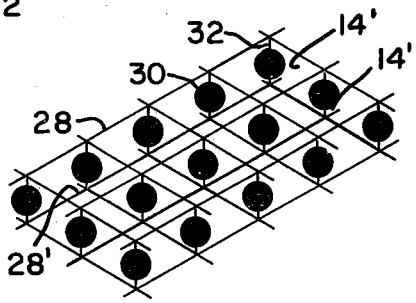
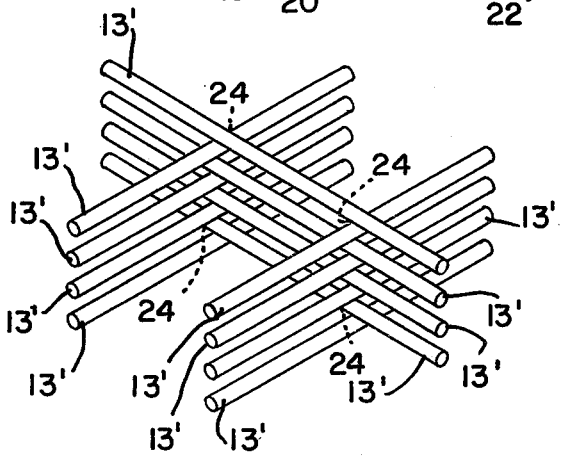
FIG. 4
FIG. 6
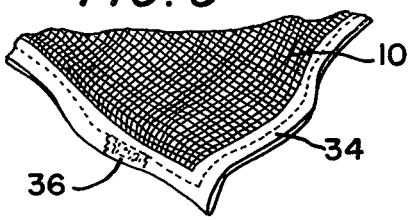

FABRIC COMPRISING A NOVEL TYPE OF NETTING

This invention pertains to fabrics, and in particular to fabrics which define voids therewithin, as in knits and the like, but more especially the invention pertains to the class of fabrics generally defined as netting.

Netting known in the prior art is suitable as screening material, in that the voids formed therewithin are of such small dimensions that mosquitoes, insects, and the like pests cannot pass through. However, too as the prior art netting is especially thin, the same is not suitable for use directly on the body. The thin, film-like nature of netting gives no protection when laid directly upon the body, the pests are free to penetrate through the voids to attack the skin.

What is needed, and has not been provided heretofore, is a type of fabric which incorporates the screening quality of netting and which, also, may be used directly on the body while having means for fending off any insect attack. Such fabrics, too, should afford adequate aspiration or ventilation, so that it can be worn with comfort in warmer climes and temperatures.

It is an object of this invention, then, to set forth a fabric of the type described in the foregoing, for which there has been a fabric which may be used directly on the body a fabric which will screen off insect attack, which can be worn with impunity from such attack, and which will not unduly retain body heat.

Particularly it is an object of this invention to disclose a fabric comprising of a multiplicity of traversing, joining, and upstanding walls, or structural threads; wherein said walls or structural threads define a multiplicity of throughgoing voids in said fabric.

Further objects of this invention, as well as the novel features thereof, will become more apparent by reference to the following description taken in conjunction with the accompanying figures, in which:

FIG. 1 is an enlarged, isometric projection of a fragment of fabric according to the invention;

FIG. 2 is an enlarged, isometric projection of a fragment of fabric according to the invention;

FIG. 3 is an enlarged, isometric projection of a detail of a type of weave which can be used to fabricate the fabric of FIG. 1 according to the invention;

FIG. 4 is a fragmentary detail of a portion of the fabric, the same being formed in a manner different from that by which the embodiment of FIGS. 1, 2, and 3 were formed;

FIG. 5 is an enlarged, isometric view of a fragment of yet another embodiment of the fabric according to the invention; and FIG. 6 is a fragmentary portion of fabric, formed according to the invention, which shows an opened section of hem in which sand, as weighting material, is confined.

As shown in FIG. 1, the novel fabric 10 is comprised of a multiplicity of traversing and upstanding walls 12 which define, therebetween, voids 14. Voids 14 are fully throughgoing, the same opening onto each side of fabric 10.

As shown in FIG. 2, the novel fabric 10 is comprised of a multiplicity of traversing and joining structural threads 13 which define, therebetween, same voids 14. In this latter embodiment, the voids 14 open onto all surfaces of the fabric, i.e., vertically and horizontally - respecting the normal plane of the fabric.

The inventive embodiments, of FIG. 1, and FIG. 2, fabric 10, can be created wthin a mold or extruded therefrom. The material used here must be stiff yet comfortable; it may be any of many suitable synthetics, nylon, orlon, fiberglass, etc. Manufacture by extrusion is an excellent method of forming the novel fabric 10 of FIGS. 1 and 2 embodiments. The void-forming walls 12 are extruded from the extruder and then cut into fabric sheets of the desired void depths (fabric 10, FIG. 1). Furthermore, the void-forming walls 12 of fabric 10 (FIG. 1) may be internally and collectively removed, without detriment to the structure, resulting only in structural threads 13 (FIG. 2), which define voids 14 in all planes (X, Y, and Z).

The inventive embodiment of FIG. 1, may be fabricated by a weave formation. Shown in FIG. 3 is a structural weave formation of the FIG. 1 embodiment of the fabric 10. As shown, first and second longitudinal walls **12*a* and 12*b* lie in parallel planes "A" and "A". Each is formed, firstly, by a serpentine strand 16 which, in turn, is enwrapped by a plurality of longitudinally-reaching, straight strands 18. Only some of the straight strands 18** are shown in full line illustration; others thereof are shown in dashed-lines. This is done only to facilitate clarity of understanding.

Strands 18 are enwrapped about limbs 20 of strand 16, as are the traversing, straight strands 22. Strands 22, also, lie in parallel planes "B" and "B'", and define third and fourth "latitudinal" walls **12*c* and 12*d***.

The inventive embodiment of FIG. 2, may be fabricated by a weave formation. The weave formation is not shown and here described. The weave defines a network of intermingling stepping threads. Each and every thread makes up continuous vertical and horizontal, right angling zig-zag steps. Each thread has a mate performing its steps opposite and others performing its steps perpendicular. By logically combining a series of these stepping threads, four threads uniting at each horizontal step, and there fused or fastened together, what will be had is the fabric 10 of FIG. 2 embodiment, according to the invention. To variate slightly from the embodiment of FIG. 2, one or more knots may be used to join together the threads at each horizontal union, thus having a weave and knot formation of the fabric 10, FIG. 2 embodiment.

Another embodiment of the invention is shown in FIG. 4 where the structural threads 13' are arrayed and interleaved, in void-forming columns and rows. Alternatively, where the novel fabric 10 is formed of nylon, or fiberglass, or the like, as priorly noted, the void-forming columns and rows can be formed electro-statically and, then, the arrayed threads are fused together where, at 24, they make contacting interfaces. In this connection, it should be noted that the fabric too can be formed of randomly arrayed threads - as even random array and interleaving will define irregularly sized and shaped voids - it remains only to assure that none of these arbitrarly configured voids are too large in area or compass.

FIG. 5 depicts still another embodiment of the invention. Here, beads are shown to space apart the fabric surfaces and to give the the fabric its protective depth. Several examples of this embodiment are disclosed. A pair of sheets 28 and 28', which have voids 14' preformed therein, are coupled together — albeit spaced apart — by beads 30. The beads 30 are threaded onto sheet-coupling strands 32. By means well known in the art, the strands 32 are fastened, at each end thereof, to the sheets 28 and 28'. The beads 30 may also be threaded in such a way as to make up the sheets 28 and 28', and eliminate sheet-coupling strands 32. This can be done by intermingling the actual threads of sheets 28 and 28' through the beads 30. The threads step from sheet to sheet, alternating, intersecting, and penetrating, four threads at each bead, thus holding each bead in place and making up the sheets 28 and 28' and the fabric of FIG. 5 embodiment. It should be well noted that other means and methods may be used to space apart the two separate sheets 28 and 28' in FIG. 5 embodiment. An example of another spacer could be a series of stiff rolling or winding threads, used instead of the beads. Whatever means used to space apart the two sheets, beads, rolling threads, coiled threads, etc., they define the walls within which voids 14' are defined; they define the depth of the fabric.

In order to insure that the voids 14 formed will be sufficiently diminutive to prevent entry of insects, the walls 12 (FIG. 1), structural threads 13 (FIG. 2), structural threads 13' (FIG. 4), or threads of sheets 28 and 28' (FIG. 5), are so formed that they define the voids with widths and lengths of between 1/32 (0.03125) and ⅛ (0.125) -inch. Yet, to fend off the insects from direct contact with the skin, the walls or structural threads (FIGS. 1, 2, 3, and 4), or beads, or rolling, winding, threads (FIG. 5), define a fabric having a depth (or thickness) of slightly deeper than the length of an insect pest's proboscis or stinger, i.e., approximately 1/16 to ¼ -inch.

As priorly noted, the novel fabric 10 is designed for use, among others, as bedding or bed covering and may be used as an outdoor bed covering sheet. To better serve this end purpose, then, my invention comprehends the definition of a fabric 10 which incorporates a weighted hem 34, as shown in FIG. 6, in which weighting material is confined. In the embodiment depicted, the weighting material 36 is sand; of course, any weighting material, could be used with equal facility in the hem 34. This type of bed covering will be very useful to campers.

Another use for the novel fabric 10 is that the fabric may be made into clothing, also previously stated. What has not been stated yet is that the clothing can serve a dual purpose. During the summer months, the clothing may be worn in complete cool comfort, worn directly upon the body, while serving to protect the body from insect attack. During the winter months, the same clothing may be worn under winter wear and serve as an insulating underwear.

It should also be noted that a suit made from such a unique fabric will be of particular use to open air (outdoors) people, and bee keepers, as well. While I have described my invention in connection with specific embodiments thereof, and specific methods of manufacture thereof, and specific uses thereof, it is to be clearly understood that this is done only by way of example, and not as a limitation to the scope of my invention as set forth in the objects thereof and in the appended claims.

I CLAIM:

1. A fabric for body protection, comprising:

a multiplicity of continuous first strands lying in a first plane parallel to, and spaced apart from each other in said first plane;

a multiplicity of continuous, second strands lying in a second plane which is parallel to said first plane, said second strands lying in said second plane parallel to, and spaced apart from each other;

a multiplicity of continuous third strands, parallel to and spaced apart from each other, and extending perpendicular to and coupled to said first strands;

a multiplicity of continuous fourth strands, parallel to and spaced apart from each other, and extending perpendicular to and coupled to said second strands; and means coupling between said first and second strands and said third and fourth strands, only in a plane normal to both said first and second planes and said fabric, effecting a spaced-apart relationship between said first and second strands and between said third and fourth strands; wherein said first, second, third and fourth strands, and said coupling means, cooperate to define a first multiplicity of throughgoing voids, extending perpendicularly of said first and second planes, and a second multiplicity of throughgoing voids which extend parallel with said first and second planes, in said fabric.

2. A fabric, according to claim 1, wherein: said coupling means comprises a multiplicity of coupling strands.

3. A fabric, according to claim 1, wherein:

said first, second, third and said fourth strands, and said coupling strands are fused together whereat each thereof defines an interface with others thereof.

4. A fabric, according to claim 1, wherein: all said voids have a width and length of between 0.03125 and 0.125-inch.

5. A fabric, according to claim 1 wherein:

said first strands are spaced apart from said second strands a distance taken from a range of from approximately 1/16- to ¼-inch.

6. A fabric, according to claim 1 wherein:

said coupling means comprises beads threaded onto strands, and said latter strands are joined to said first, second, third and fourth strands.

* * * * *